US007396057B2

(12) United States Patent
Ye et al.

(10) Patent No.: US 7,396,057 B2
(45) Date of Patent: Jul. 8, 2008

(54) LIFTING MAGNET

(75) Inventors: Hae-kum Ye, Pusan-si (KR); Chang-ki Han, Pusan-si (KR); Young-ho Kim, Pusan-si (KR)

(73) Assignee: Daesung Magnet Co., Ltd. (KR)

( * ) Notice: Subject to any disclaimer, the term of this patent is extended or adjusted under 35 U.S.C. 154(b) by 88 days.

(21) Appl. No.: 10/577,002

(22) PCT Filed: Oct. 22, 2004

(86) PCT No.: PCT/KR2004/002707

§ 371 (c)(1),
(2), (4) Date: Apr. 24, 2006

(87) PCT Pub. No.: WO2005/040031

PCT Pub. Date: May 6, 2005

(65) Prior Publication Data

US 2007/0035141 A1 Feb. 15, 2007

(30) Foreign Application Priority Data

Oct. 24, 2003 (KR) ..... 10-2003-0074629

(51) Int. Cl.
*B66C 1/04* (2006.01)

(52) U.S. Cl. ..... 294/65.5; 335/288; 335/295

(58) Field of Classification Search ..... 294/65.5; 335/285, 288, 295; 269/8
See application file for complete search history.

(56) References Cited

U.S. PATENT DOCUMENTS 3,477,050 A * 11/1969 Hinger ..... 335/285
4,250,478 A * 2/1981 Cardone et al. ..... 335/288
4,893,858 A 1/1990 Yoshitani et al. ..... 294/65.5
5,382,935 A * 1/1995 Doyelle ..... 335/288
5,435,613 A * 7/1995 Jung ..... 294/65.5
6,076,873 A * 6/2000 Jung ..... 294/65.5
6,331,810 B1 * 12/2001 Jung ..... 335/288

(Continued)

FOREIGN PATENT DOCUMENTS

CN 1243093 A 2/2000

(Continued)

OTHER PUBLICATIONS

Chinese Office Action mailed Feb. 1, 2008 and English Translation thereof.

*Primary Examiner*—Dean J Kramer
(74) *Attorney, Agent, or Firm*—Cantor Colburn LLP

(57) ABSTRACT

A lifting magnet having a housing, a rotary magnet unit, and a stationary magnet unit. The lifting magnet also includes a pinion, a socket moving up and down, a slider rotating the pinion to set the magnetization and demagnetization states at top and bottom dead points, respectively, a locking part provided in one of the socket and the slider, a locking unit provided in the other, including a locker, and moving both the socket and the slider up and down while the locker is locked to the locking part, and a locking unit driver alternately driving the locking unit to make the locker released from and locked to the locking part at first and second moving operations, respectively. With this configuration, the lifting magnet can stably keep on and off states of an attractive magnetic force and conveniently performs lifting and carrying operations.

10 Claims, 13 Drawing Sheets

U.S. PATENT DOCUMENTS 6,663,154 B2 * 12/2003 Pancheri ..... 294/65.5

FOREIGN PATENT DOCUMENTS

JP 2-305797 12/1990
JP 8-324951 12/1996
KR 100288245 B1 5/2001
KR 2002-0036825 5/2002

* cited by examiner

LIFTING MAGNET

FIELD OF THE INVENTION

The present invention relates to a lifting magnet, and more particularly, to a lifting magnet employing a permanent magnet to carry a steel plate or the like.

BACKGROUND ART

Generally, a lifting magnet comprises a rotary magnet disposed on a rotational shaft in the center of a housing, and a stationary magnet placed on inner opposite sides of the housing in correspondence with the rotary magnet, so that the housing exerts an attractive magnetic force when the rotary magnet is rotated in a first direction and allows the same magnetic poles of the rotary and stationary magnets to face each other, but the attractive magnetic force is canceled when the rotary magnet is rotated in a second direction and allows the different magnetic poles of the rotary and stationary magnets to face each other. Thus, the lifting magnet is installed in a carrier such as a crane, etc. to lift and carry a heavy steel plate using the magnetic force.

Such a lifting magnet is disclosed in Korean Patent Publication No. 1998-72201.

A conventional lifting magnet comprises a pinion placed in the middle of the rotational shaft to which the rotary magnet is coupled, and a rack provided in an operating unit and engaged with the pinion, wherein the operation unit moves up and down through the middle inside of the housing. Therefore, when the operating unit moves up or down, the rotary magnet is rotated along with the pinion by an angle of 180 degree, so that the lifting magnet is automatically turned on/off to exert and cancel the attractive magnetic force.

Further, the conventional lifting magnet comprises a separate connecting rod placed in the middle of the rotational shaft and allowing the pinion to rotate on its axis against the rotational shaft when the operating unit moves down; and a cylindrical body formed integrally with the pinion and placed on the connecting rod with a bearing. Here, the cylindrical body comprises therein a locking part having a resilient piece; a cam body to be locked to the locking part; and a disc formed integrally with the cam body, which are respectively arranged in consideration of a rotating direction of the rotational shaft. Further, a magnetic pole holding disc having a ratchet shape, together with a stopper, is provided in one end of the rotational shaft.

However, in the conventional lifting magnet, when the lifting magnet is connected to the crane and moves up from the state that the lifting magnet is put on the ground and the attractive magnetic force is set to be turned off, the operating unit first moves up due to the lifting magnet's own weight and at the same time the attractive magnetic force becomes turned on, so that various foreign materials around the lifting magnet are attached to the lifting magnet and therefore the attractive magnetic force becomes weak, thereby making it difficult to smoothly lift and carry the steel plate. Particularly, the attractive magnetic force can be set to be turned on/off only when the operating unit moves up, so that it is difficult for a user to correctly determine the state of the lifting magnet and to carry the steel plate.

Further, in the case where the attractive magnetic force is set to be turned on, because the same magnetic poles of the rotary magnet and the stationary magnet face to each other, a strong repulsive force is exerted between the rotary magnet and the stationary magnet and makes the rotary magnet tend to rotate with respect to the rotational shaft to turn off the attractive magnetic force. In this case, it is impossible to rotate the rotational shaft in the first direction because the pinion is engaged with the rack. However, with regard to the second direction, the free rotation of the rotational shaft is restricted by only a spring force of the stopper, so that the attractive magnetic force is unstably kept, thereby threatening safety of a worker.

Further, the stopper is used for two incompatible purposes of not only smoothly rotating the pinion while the rack moves up but also holding/preventing the pinion from rotating when the attractive magnetic force is set to be turned on, so that it is not easy to secure the operations of the stopper. Also, because the stopper is exposed to the outside, the stopper may be easily released from a locking state or broken due to strong sway or collision with an obstacle while the steel plate is lifted and carried by the lifting magnet installed in the crane, so that the steel plate is likely to be detached from the lifting magnet and fall.

Besides, the magnetic pole of the rotary magnet is eccentrically formed with regard to that of the stationary magnet, so that the attractive magnetic force of the lifting magnet is weakened when the attractive magnetic force is in the on state. Further, the attractive magnetic force is not completely turned off and remains in the lifting magnet even though the attractive magnetic force is in the off state, so that foreign materials as well as the steel plate are attached to the lifting magnet, thereby weakening the attractive magnetic force and causing risk in safety.

DISCLOSURE OF INVENTION

Accordingly, it is an aspect of the present invention to provide a lifting magnet, which can stably keep on and off states of an attractive magnetic force and conveniently performs lifting and carrying operations.

The foregoing and other aspects of the present invention are achieved by providing a lifting magnet comprising a housing; a rotary magnet unit rotatably accommodated in the housing and comprising a pair of permanent magnets having opposite magnetic poles and a rotational shaft; a stationary magnet unit comprising a pair of permanent magnets surrounding the rotary magnet unit and facing each other across the rotary magnet unit and determining a magnetization state and a demagnetization state according to rotated positions of the rotary magnet unit, the lifting magnet further comprising a pinion coupled to the rotational shaft; a socket moving up and down within a predetermined lifting stroke with respect to the housing; a slider comprising a toothed rack portion to be engaged with the pinion, moving up and down within the lifting stroke, and rotating the pinion to set the magnetization state at a top dead point and set the demagnetization state at a bottom dead point; a locking part provided in one of the socket and the slider; a locking unit provided in the other of the socket and the slider, comprising a locker to be locked to and released from the locking part, and moving both the socket and the slider up and down in the state that the locker is locked to the locking part; and a locking unit driver alternately driving the locking unit to release the locker from the locking part at a first moving operation of the socket, and to lock the locker to the locking part at a second moving operation of the socket.

According to another aspect of the present invention, the locking unit driver comprises an elastic unit provided to slide in a direction transverse to the moving direction of the socket, and exerting a predetermined elastic force to the locking unit to make the locker of the locking unit be locked to the locking part; and a latch resisting the elastic force of the elastic unit, reciprocating between a latching position preventing the locking unit from moving toward the locking part and a releasing position allowing the locking unit to move toward the locking part, and contacting and separating from the locking unit, wherein the latch is placed on the latching position when the socket first moves up and second moves down, and the latch is placed on the releasing position when the socket first moves down and second moves up.

According to another aspect of the present invention, the locking unit driver comprises a latch elastic unit exerting a predetermined elastic force to place the latch on the latching position; and a pusher pressing the latch to place the latch on the releasing position according as the socket moves down in the state that the locker is released from the locking part.

According to another aspect of the present invention, the lifting magnet further comprises a projection protruding from an outer wall of the socket; a socket case comprising a stopper to stop the projection and to limit the moving up operation of the socket, coupled to the housing, and supporting the socket to move up and down.

According to another aspect of the present invention, the lifting magnet further comprises a band rotatably coupled to the socket case, and coupling the socket with the socket case to prevent the socket from moving up out of the socket case.

According to another aspect of the present invention, the lifting magnet further comprises at least one idle gear provided between the pinion and the slider, rotated while being engaged with the rack toothed portion according as the slider moves up and down, and transferring a rotational force to the pinion.

MODES FOR CARRYING OUT THE INVENTION

Figure 1:
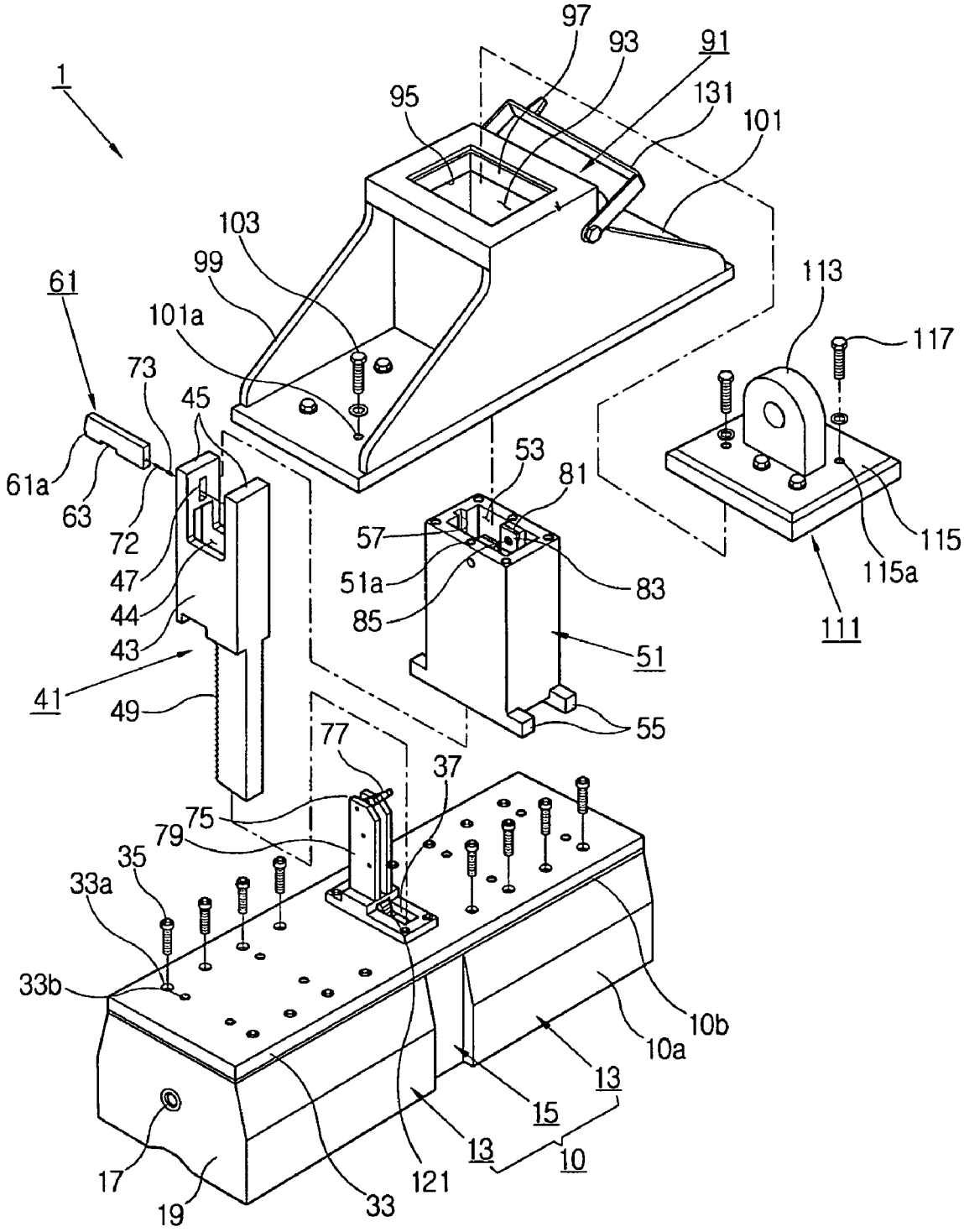
FIG. 1 is an exploded perspective view of a lifting magnet according to an embodiment of the present invention.
Figure 2:
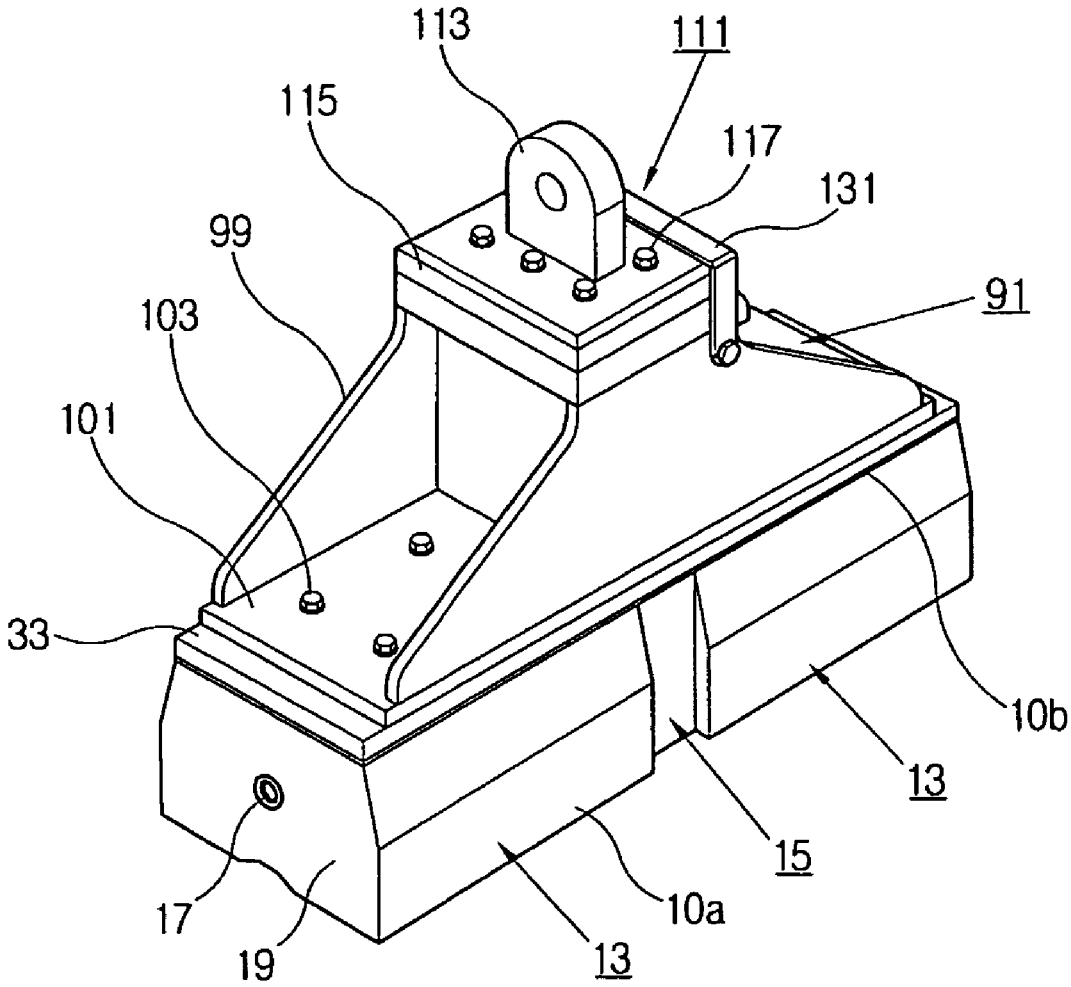
FIG. 2 is an assembled perspective view of the lifting magnet in FIG. 1.
Figure 3:
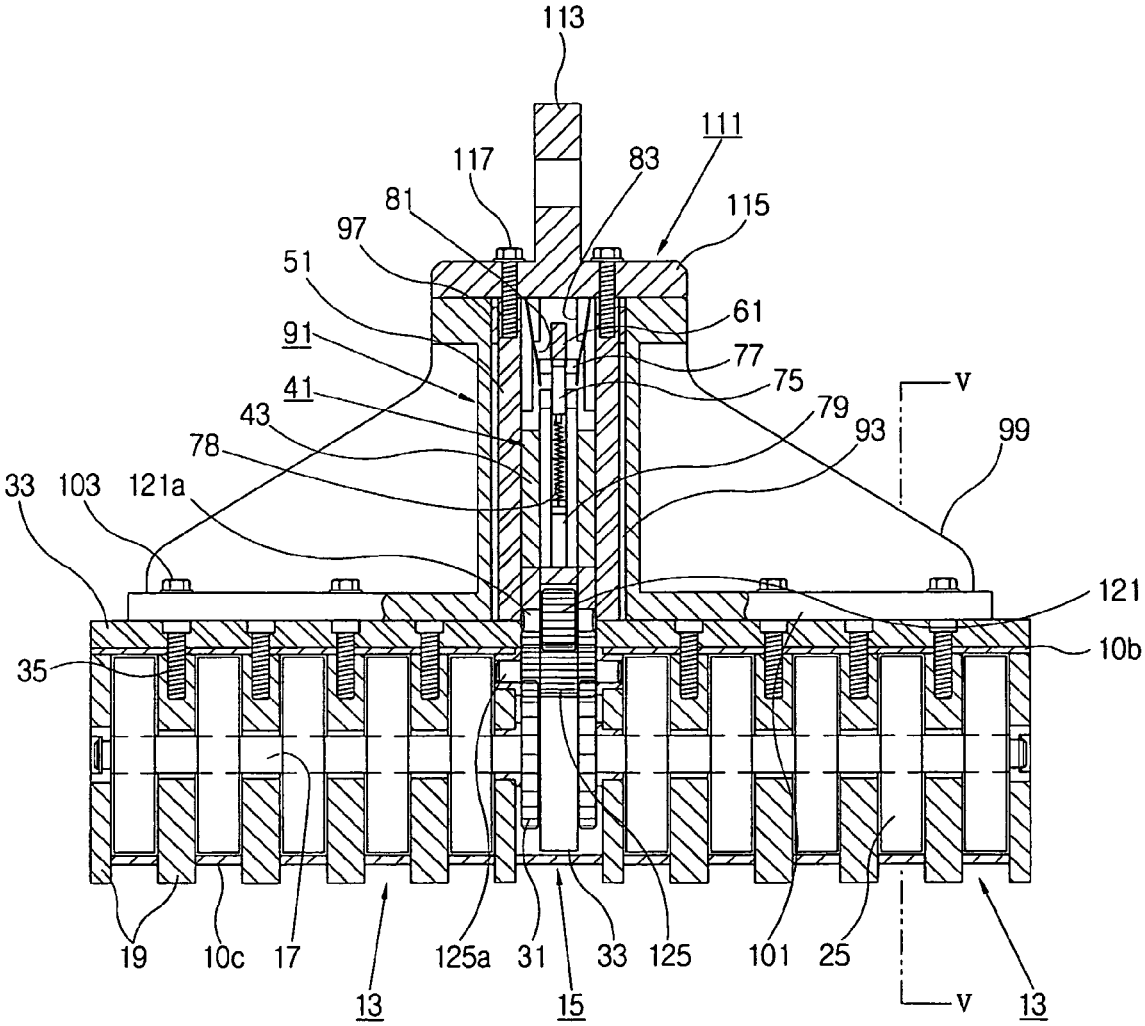
FIG. 3 in a front sectional view of the lifting magnet in FIG. 2.
Figure 4:
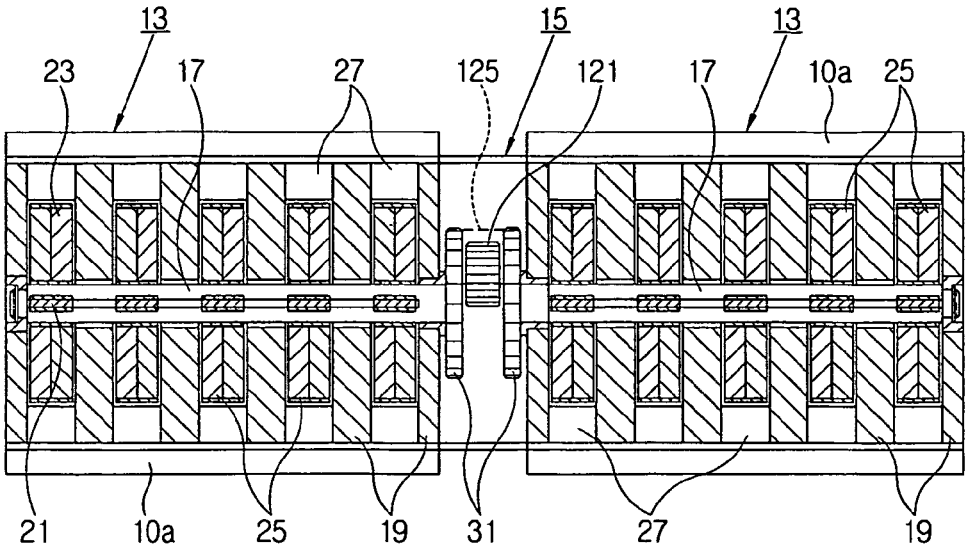
FIG. 4 is a plan sectional view of the lifting magnet in FIG. 2.
Figure 5:
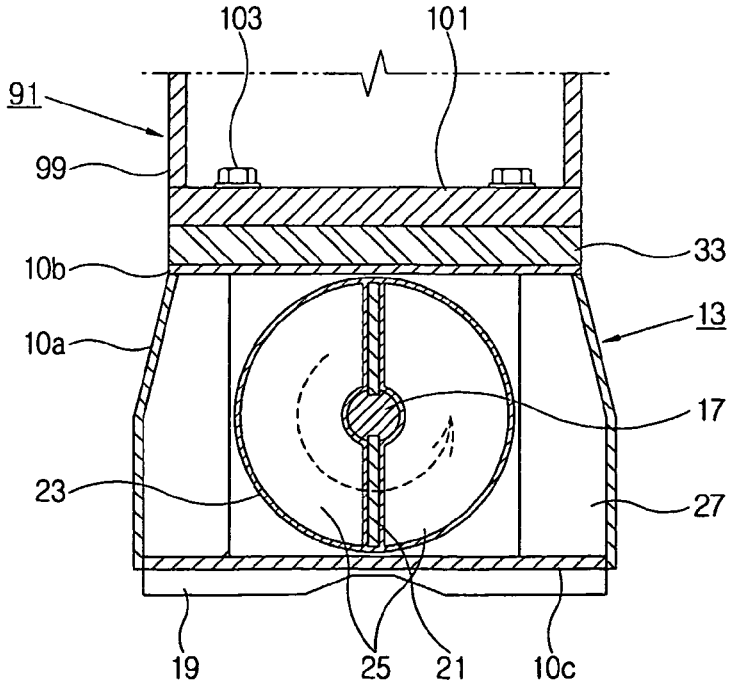
FIG. 5 is a sectional view of the lifting magnet in FIG. 3, taken along line V-V.

Hereinbelow, preferable embodiments of the present invention will be described with reference to accompanying drawings.

As shown in FIGS. 1 through 5, a lifting magnet 1 according to an embodiment of the present invention has a housing 10 comprising a pair of lateral walls 10*a*, and an upper plate 10*b* and a lower plate 10*c* to respectively close an upper opening and a lower opening formed by the lateral walls 10*a*. Preferably, the lateral walls 10*a*, the upper plate 10*b*, and the lower plate 10*c* are made of nonmagnetic materials.

The housing 10 comprises a pair of magnet housings 13 to accommodate a rotary magnet 25 and a stationary magnet 27; and a driving unit housing 15 placed between the pair of magnet housing 13 and accommodating a pinion 31 and a rack toothed portion 49 of a slider 41 (to be described later) for driving the rotary magnet 25 to rotate.

The housing 10 comprises a single rotational shaft 17 rotatably coupled thereto across the pair of magnet housings 13 and the driving unit housing 15.

The magnet housing 13 is integrally provided with a plurality of magnetic partition walls 19 therein at predetermined intervals. The magnetic partition walls 19 are divided into a front part and a back part by a nonmagnetic plate (now shown) disposed along the center of the magnetic walls 19. The magnetic partition walls 19 placed in opposite edges of both the magnet housings 13 for a casing shape together with the pair of lateral walls 10*a*.

Meanwhile, the plurality of rotary magnets 25, which comprises a pair of permanent magnets having a semicircular shape and separately inserted in a nonmagnetic cylindrical body 23 coupled by a key 21 to the rotational shaft 17 penetrating the center of the magnet housing 13, is rotatably inserted between the respective magnetic partition walls 19. Further, Inside the lateral walls 10*a* of the magnet housing 13 frontward and backward corresponding to the rotary magnet 25 are provided a pair of permanent magnet units surrounding the rotary magnet 25 and opposite to each other across the rotary magnet 25, and the plurality of stationary magnets 27 fastened between the respective magnetic partition walls 19 and determining a magnetization state or a demagnetization state according to rotated positions of the rotary magnet 25.

Thus, when the rotary magnet 25 is rotated integrally with the rotational shaft 17 in a first direction, the same magnetic poles of the rotary magnet 25 and the stationary magnet 27 are faced each other, thereby magnetizing the magnetic plate 19. That is, the magnetic plate 19 is magnetized, so that an attractive magnetic force is exerted through a bottom of the magnet housing 13. Thus, the attractive magnetic force of the lifting magnet 1 is in an on state.

On the other hand, when the rotary magnet 25 is rotated integrally with the rotational shaft 17 in a second direction, different magnetic poles of the rotary magnet 25 and the stationary magnet 27 are faced each other, so that the magnetic plate 19 is not magnetized. That is, the magnetic plate 19 is demagnetized, so that the attractive magnetic force exerted from the magnet housing 13 is canceled out. Thus, the attractive magnetic force of the lifting magnet 1 is in an off state.

Meanwhile, the driving unit housing 15 accommodates therein the pinion 31 coupled with the rotational shaft 17.

Further, the housing 10 comprises a cover 33 to cover the upper plate 10*b*, and the cover 33 is formed with a plurality of through holes 33*a*. Through the through holes 33*a*, a bolt 35 is fastened to the magnetic partition wall 19 of the magnet housing 13, so that the cover 33 is coupled to the upper plate 10*b* of the housing 10. Also, the cover 33 is formed with a slider through hole 37 through which the slider 41 is retracted in and protracted from the driving unit housing 15.

The slider 41 is reciprocated within a predetermined lifting stroke, i.e., between a top dead point and a bottom dead point. The slider 41 rotates the pinion 31, thereby the rotary magnet 25 and the stationary magnet 27 to be in the magnetization state at the top dead point and to be in the demagnetization state at the bottom dead point. The slider 41 comprises a slider body 43 formed with a frame insertion portion 44 to which a latch frame 79 (to be described later) is inserted therein; and the rack toothed portion 49 longitudinally extending from one end of the slider body 43, inserted in the driving unit housing 15 through the slider through hole 37 of the cover 33, and rotating the pinion 31 to rotate the rotary magnet 25 in the magnet housing 13.

In an upper portion of the slider body 43 of the slider 41 are provided a pair of supporters 45, and a locking unit through hole 47 to insertably support a locking unit 61 (to be described later) between the pair of supporters 45.

In an upper portion of the cover 33 is provided with a socket 51 moving up and down within a predetermined lifting stroke, i.e., between a top dead point and a bottom dead point with respect to the housing 10. The socket 51 is shaped like a box having opposite openings, and formed with a slider insertion portion 53 therein to which the slider 41 is inserted. Further, a pair of projections 55 protrudes from lower opposite outer walls of the socket 51.

In an upper inside wall of the socket 51 is cut and formed a locking part 57 to which a locker 61*a* of the locking unit 61 (to be described later) is locked. According to an embodiment of the present invention, the locking part 57 is recessed at a predetermined depth in a direction perpendicular to a moving direction of the socket 51.

The locking unit 61 comprises the locker 61*a* locked to and released from the locking part 57, allows the socket 51 and the slider 41 to integrally move up and down in the state that the locker 61*a* is locked to the locking part 57, and is retractably and protractably supported in the locking unit through hole 47 of the slider 41.

The locking unit 61 is driven by a locking unit driver to alternately release the locker 61*a* from the locking part 57 at a first moving operation of the socket 51 or lock the locker 61*a* to the locking part 57 at a second moving operation.

The locking unit driver comprises an elastic unit 72 exerting a predetermined elastic force on the locking unit 61 to make the locker 61*a* to the locking part 57; and a latch 75 resisting the elastic force of the elastic unit 72, reciprocating between a latching position preventing the locking unit 61 from moving toward the locking part 57 and a releasing position allowing the locking unit 61 to move toward the locking part 57, and contacting and separating from the locking unit 61.

The elastic unit 72 is provided to slide in a direction transverse to the moving direction of the socket 51, and exerts a predetermined elastic force to the locking unit 61 so as to lock the locker 61*a* to the locking part 57 in the case of the second moving operation of the socket 51. The elastic unit 72 is supported by a pin 73 on an end portion opposite to the locker 61*a* of the locking unit 61.

The latch 75 is hingedly coupled to the latch frame 79 at a predetermined angle, wherein the latch frame 79 is vertically protruding from the upper portion of the cover 33. The latch 75 has a first end elastically supported by a latch elastic unit 78; and a second end, i.e., a free end formed with a switch pin 77 protruding from opposite sides thereof. Preferably, the locking unit 61 is formed with a contact groove 63 cut by a predetermined length along a moving direction thereof, so that the free end of the latch 75 can contact the contact groove 63.

The latch elastic unit 78 exerts a predetermined elastic force to place the latch 75 on the latching position, that is, to make the latch 75 contact the locking unit 61 and prevent the locking unit 61 from moving toward the locking part 57.

Further, the locking unit driver comprises a pusher 81 to press the latch 75, thereby placing the latch 75 on the releasing position according as the socket 51 moves down in the state that the locker 61*a* is released from the locking part 57, that is, moving the locking unit 61 toward the locking part 57 by spacing out the latch 75 from the locking unit 61. The pusher 81 is fastened onto the upper opposite inner walls of the socket 51 through a pusher coupling hole 83 and a bolt 85, and pushes the switch pin 77 of the latch 75 downward when the socket 51 moves down, thereby spacing out the latch 75 from the locking unit 61.

According to an embodiment of the present invention, the elastic unit 72 and the latch elastic unit 78 are realized by a coil spring. Alternatively, the elastic unit 72 and the latch elastic unit 78 may be realized by a flat spring, a spiral spring, etc. instead of the coil spring.

Meanwhile, the lifting magnet 1 according to an embodiment of the present invention further comprise a socket case 91 coupled to the housing 10 and supporting the socket 51 to move up and down. Inside the socket case 91 is formed a socket insertion portion 93 to which the socket 51 is inserted. In an upper portion of the socket insertion portion 93 is provided with a stopper 95 to stop the projection 55 of the socket 51 and prevent the socket 51 from moving up. Preferably, a bushing 97 is provided in an upper inside circumference of the socket insertion part 93 including the stopper 95, thereby minimizing friction and noise due to the moving operation of the socket 51.

Further, the socket case 91 comprises a bottom plate 101 reinforced with a reinforcing plate 99 to support the weight of the housing 10 coupled to a bottom of the socket case 91, and contacting the upper portion of the cover 33. The bottom plate 101 of the socket case 91 is formed with a plurality of through holes 101*a*, and coupled to the cover 33 with a fastening bolt 103 passing through the through hole 101*a* of the bottom plate 101 and the coupling hole 33*b* of the cover 33. Further, an opening (not shown) is formed on the center of the bottom plate 101 in order to insert the socket 51 in the socket insertion portion 93.

Further, in the upper portion of the socket case 91 is provided a pulling-up unit 111 integrally formed with a ring 113. The pulling-up unit 111 is coupled to the socket 51 by a fastening bolt 117 passing through a fastening hole 115*a* formed on a bottom 115 of the pulling-up unit 111 and the a coupling hole 51*a* formed on a top of the socket 51.

Meanwhile, the lifting magnet 1 according to an embodiment of the present invention further comprises a first idle gear 121 and a second idle gear 125 provided between the rack toothed portion 49 of the slider 41 and the pinion 31, rotated while being engaged with the rack toothed portion 49 according as the slider 41 moves up and down, and transferring its rotational force to the pinion 31.

The first idle gear 121 is rotatably provided in the latch frame 79, and engaged with the rack toothed portion 49 of the slider 41. Further, the second idle gear 121 is provided between the pinion 31 and the first idle gear 121, and engaged with the pinion 31 and the first idle gear 121.

Thus, the lifting stroke of the slider 41 causing the pinion 31 to rotate is more extended. Therefore, the rotational shaft 17 connected to the pinion 31 can be rotated at an angle of 180 degree by rotating the respective idle gears 121 and 125 without a separate space for the moving operation of the slider 41 between the pinion 31 and the lower plate 10*c* of the driving unit housing 15.

Further, the lifting magnet 1 according to an embodiment of the present invention comprises a band 131 rotatably coupled to the socket case 91, surrounding the upper portion of the socket 51, and coupling the socket 51 with the socket case 91 to prevent the socket 51 from moving up out of the socket case 91. Here, the band 131 is selectively provided.

In the meanwhile, reference numerals 121*a* and 125*a* indicate gear shafts.

With this configuration, the lifting magnet 1 according to an embodiment of the present invention operates as follows.

Figure 6A:
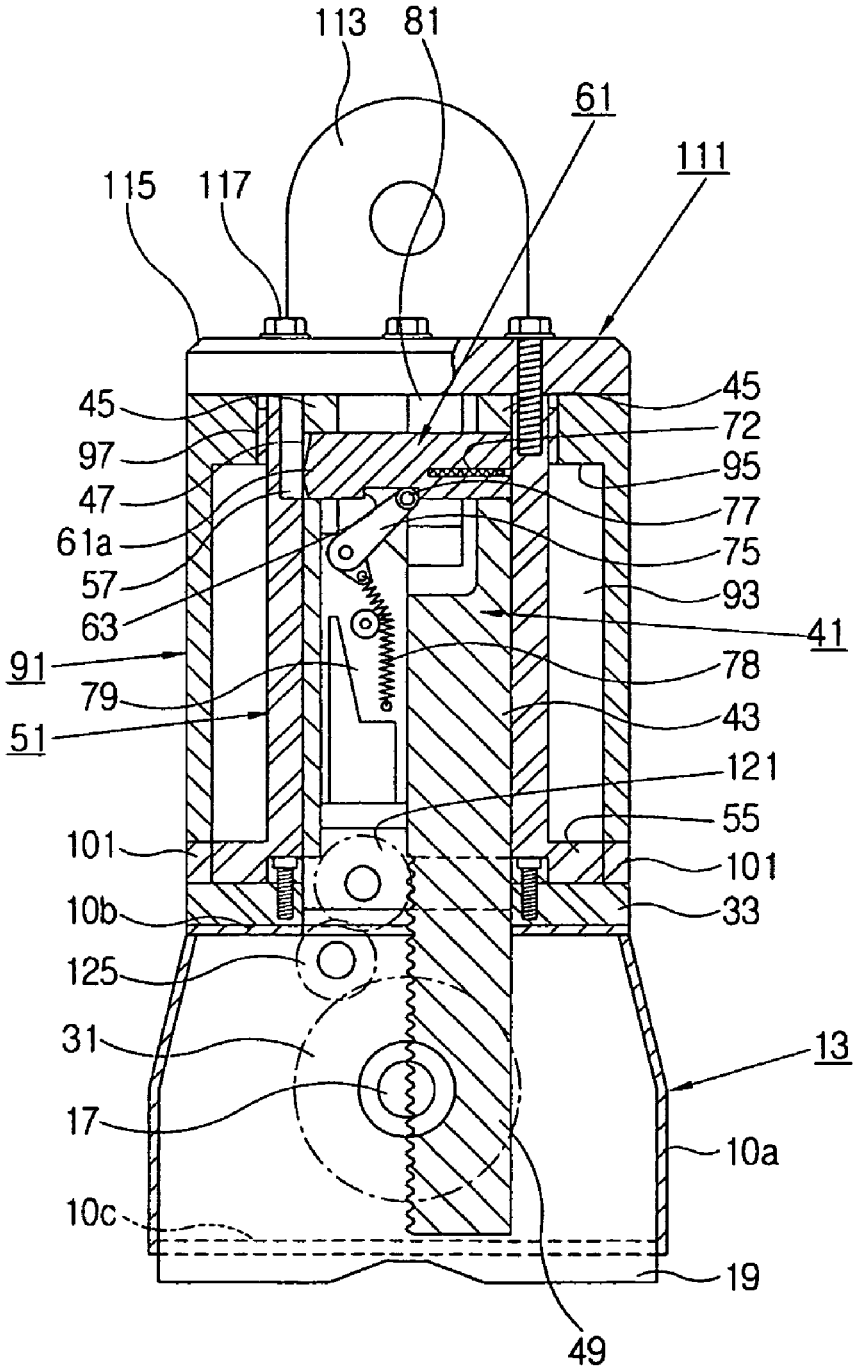
FIGS. 6A through 6E are side sectional view showing operations of the lifting magnet according to an embodiment of the present invention.
Figure 7A:
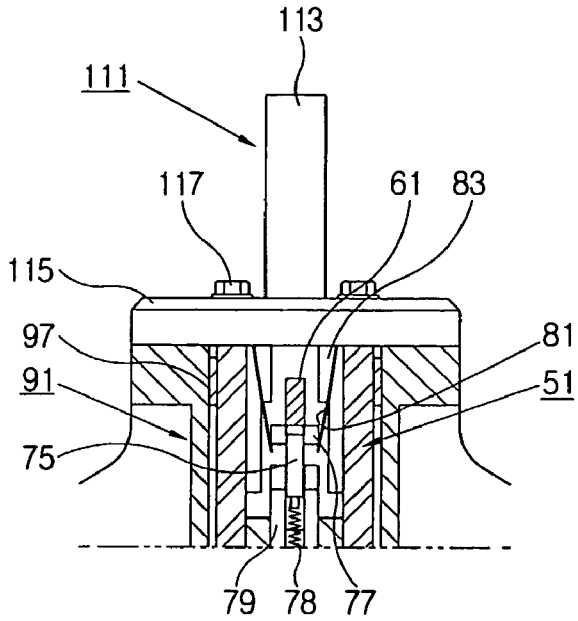
FIGS. 7A through 7E are cross sectional views showing operations of a latch and a pusher provided in the lifting magnet according to an embodiment of the present invention.

First, as shown in FIG. 6A, the attractive magnetic force of the lifting magnet 1 is in the off state, in which the lifting magnet 1 is put on a ground. In this state, the rack toothed portion 49 of the slider 41 is moved down onto the bottom of the housing 10 through the inside of the driving unit housing 15, and at the same time the locking unit 61 inserted between the supporters 45 of the slider 41 is pushed by the latch 75 rightward (with respect to FIG. 6A for the convenience of description). That is, the latch 75 is placed on the latching position and the locker 61*a* is released from the locking part 57. Further, as shown in FIG. 7A, the switch pin 77 of the latch 75 is inserted between the pair of pusher 81.

Meanwhile, the locking unit 61 is movable toward the locking part 57 by both the elastic force of the latch elastic unit 78 pulling the latch 75 and the elastic force of the elastic unit 72 elastically supporting the locking unit 61. However, in the state shown in FIG. 6A, because the locking unit 61 is supported at two points between the supporters 45 of the slider 41, and the free end of the latch 75 cannot rotate in an upward direction with respect to the hingedly coupled point, i.e., a leftward direction (with respect to FIG. 6A for the convenience of description), the locking unit 61 is prevented from being freely released from the supporters 45.

Figure 6B:
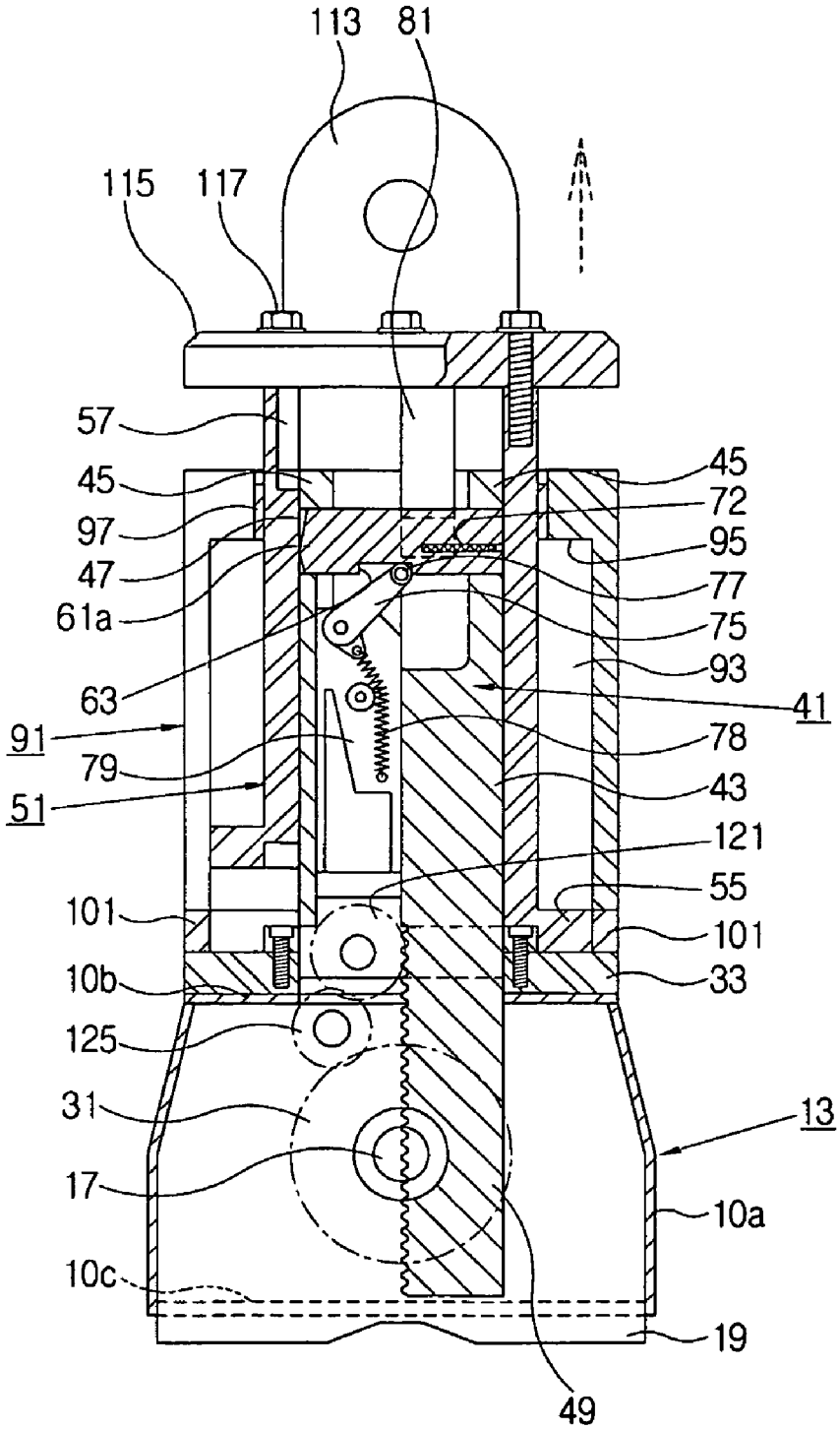
Figure 7B:
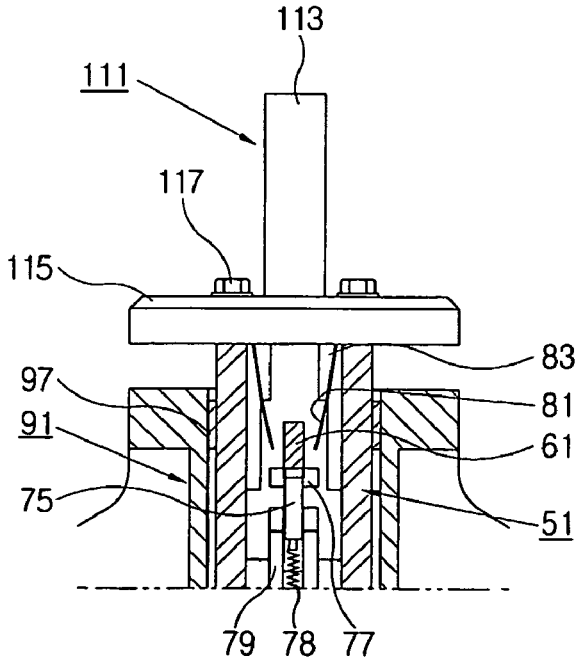

In this state, the ring 113 is connected to a carrying apparatus such as a hoist, a crane, etc. through a rope or the like, and then the lifting magnet 1 is first moved up. Then, as shown in FIG. 6B, only the socket 51 integrally connected to the pulling-up unit 111 is lifted up together with the pulling-up unit 111 due to the lifting magnet's own weight. However, the slider 41 being not locked to the socket 51 is maintained as it does not move up, thereby keeping the off state of the attractive magnetic force of the lifting magnet 1. At this time, as shown in FIG. 7B, the latch 75 is placed on the latching position, and at the same time the switch pin 77 of the latch 75 is spaced from the pair of pushers 81 of the socket 51.

Sequentially, the socket 51 together with the pulling-up unit 111 continuously moves up, so that the projection 55 of the socket 51 is stopped by the stopper 95 of the socket case 91. Then, the pulling-up unit 111, the socket case 91 including the socket 51 and the slider 41, and the housing 10 placed under the socket case 91 are all moved up, thereby lifting up the lifting magnet 1. Thus, the lifted lifting magnet 1 is moved over the steel plate to be carried, and then put on the steel plate.

Figure 6C:
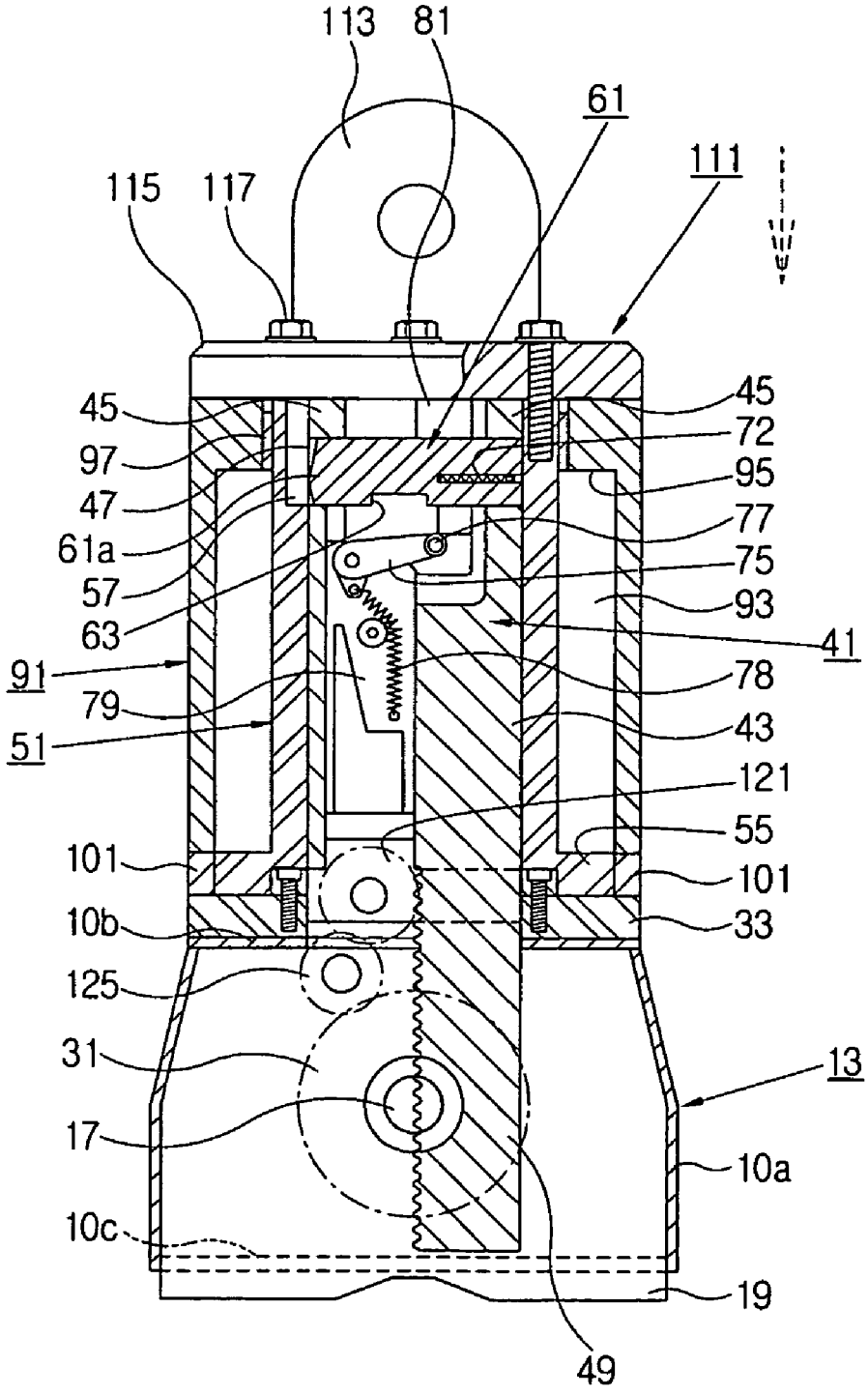
Figure 7C:
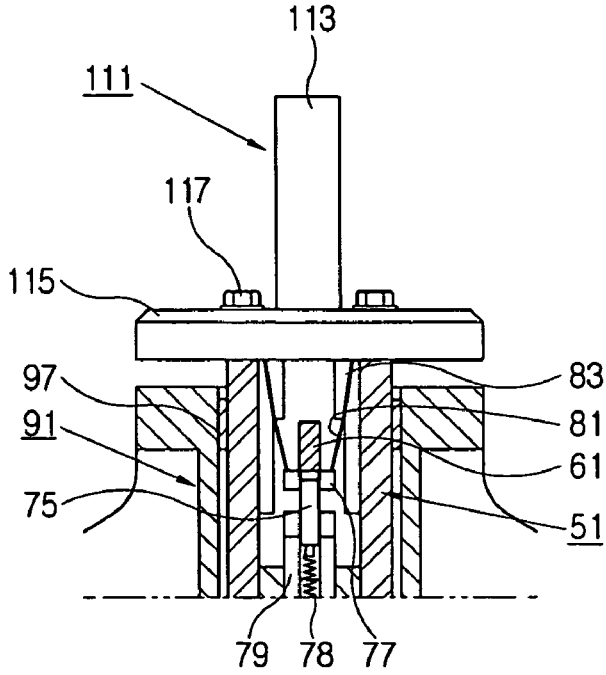
Figure 7D:
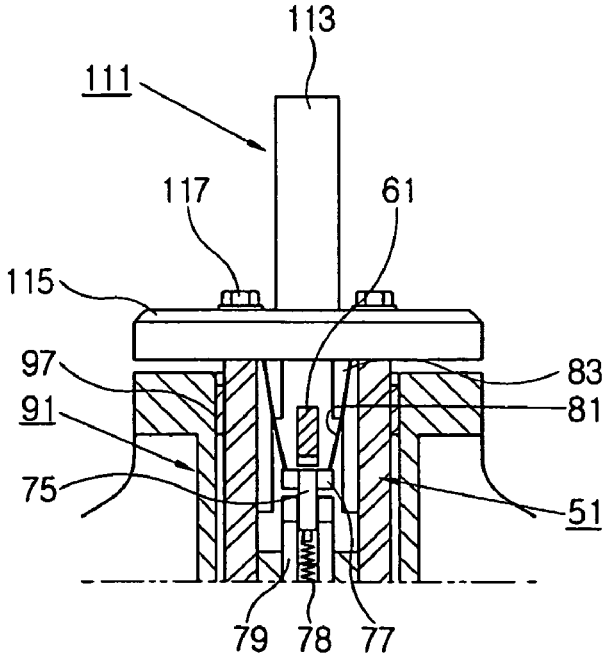
Figure 7E:
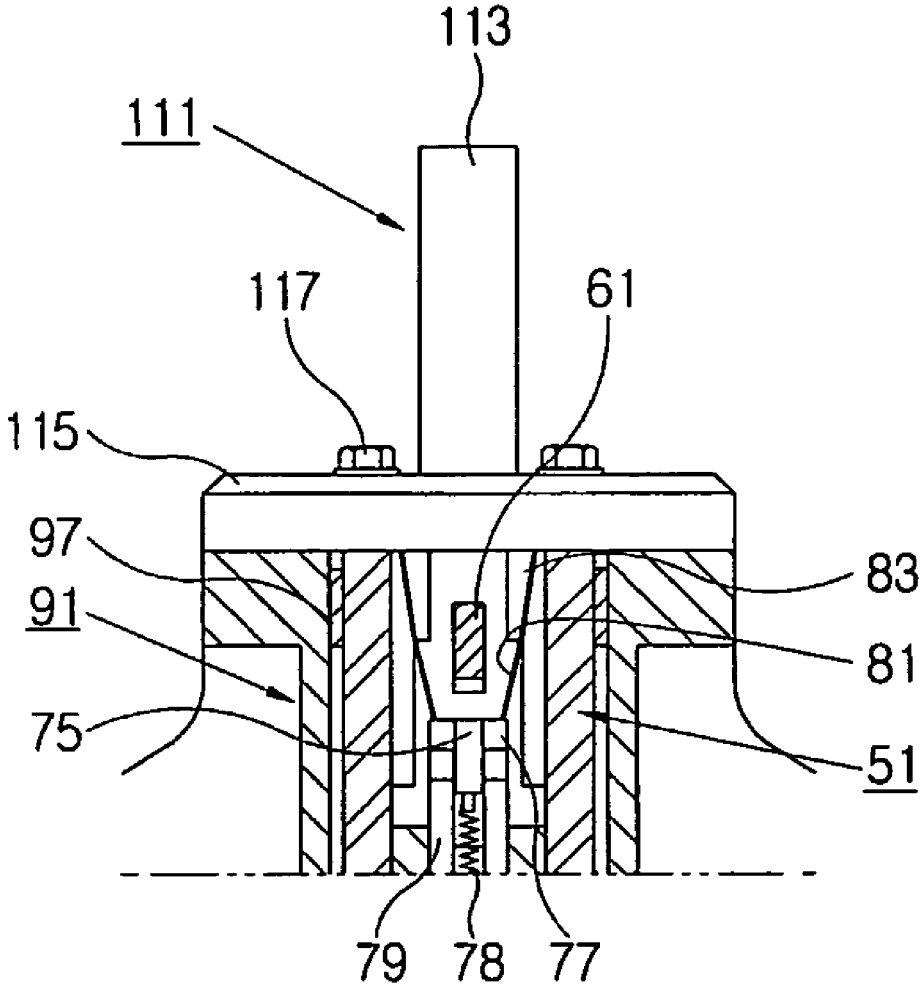

When the lifting magnet 1 is put on the steel plate to be carried, the housing 10 is first put on the steel plate, and then the socket 51 together with the pulling-up unit 111 first moves down along the socket case 91 as shown in FIG. 6C. At this time, while the socket 51 moves down, the pusher 81 presses the switch pin 77 of the latch 75 downward as shown in FIGS. 7C through 7E, thereby rotating the latch 75 supporting the locking unit 61 downward.

Thus, when the latch 75 is rotated downward by the pusher 81, the latch 75 is placed on the releasing position. That is, the free end of the latch 75 is released from the contact groove 63 of the locking unit 61, thereby releasing the locking unit 61 from the locked state due to the latch 75. Then, the locker 61*a* of the locking unit 61 is placed outside the slider 41 through the locking unit through hole 47 of the supporter 45 by the elastic force of the elastic unit 72, thereby being locked to the locking part 57 of the socket 51.

Figure 6D:
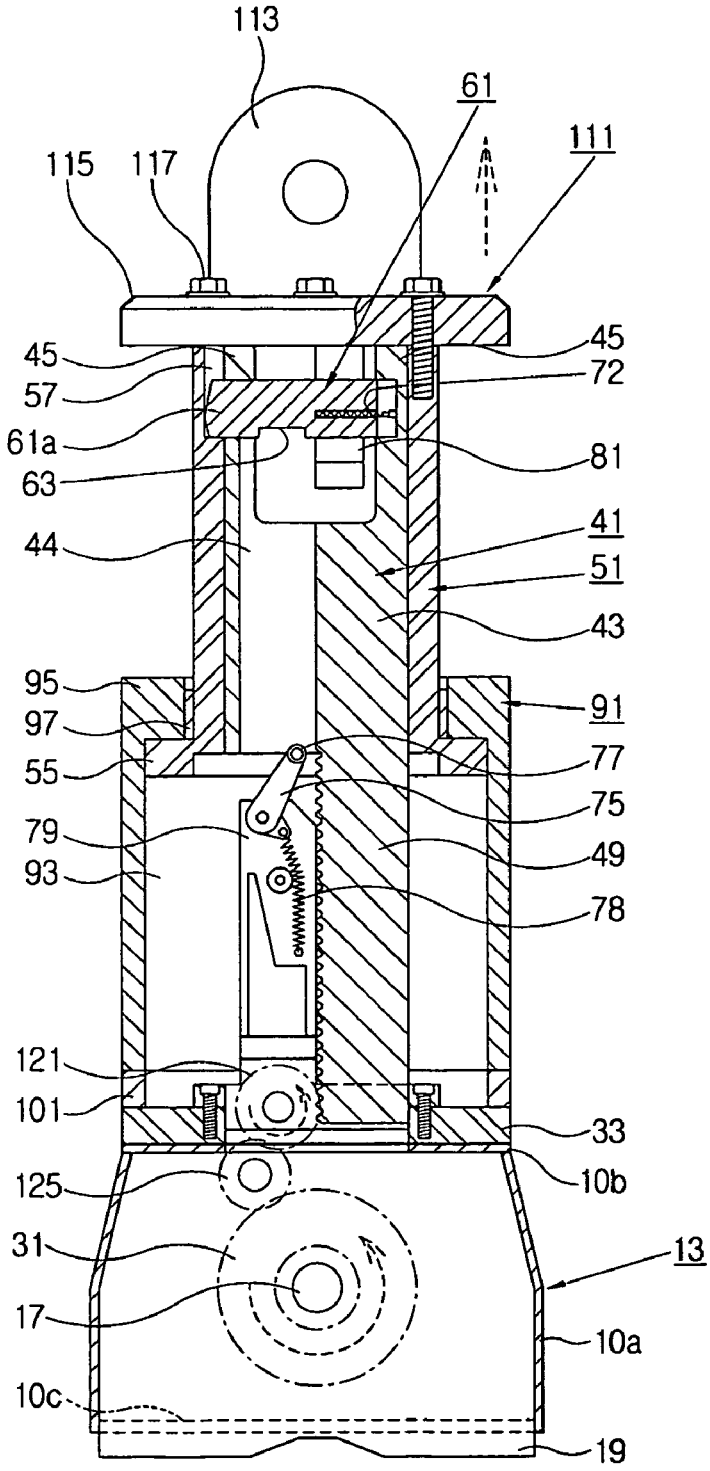

Then, after the lifting magnet 1 is put on the steel plate in the state that the locker 61*a* of the locking unit 61 is locked to the locking part 57, when the lifting magnet 1 is second moved up by the carrying apparatus such as the hoist or the crane, the pulling-up unit 11 and the socket 51 are first moved up. At this time, the locker 61*a* of the locking unit 61 is locked to the locking part 57 in the state that the latch 75 is released from the locking unit 61, i.e., in the state that the latch 75 is placed on the releasing position. Therefore, as shown in FIG. 6D, the pulling-up unit 111, the socket 51 and the slider 41 are all moved up.

According as the socket 51 and the slider 41 are all moved up, the first idle gear 121 and the second idle gear 125 engaged with the rack toothed portion 49 of the slider 41 are rotated, so that the pinion 31 connected to the rotational shaft 17 is rotated. Then, the pinion 31 is rotated by an angle of 180 degree when the projection 55 is stopped by the stopper 95 of the socket case 91, that is, at the top dead point of the lifting stroke. Therefore, the same magnetic poles of the rotary magnet 25 and the stationary magnet 27 are faced to each other, thereby entering a magnetization state. That is, the attractive magnetic force is exerted from the magnet housing 13, so that the lifting magnet 1 is in the on state.

At the same time when the attractive magnetic force of the lifting magnet 1 is set as the on state, the steel plate beneath the bottom of the lifting magnet 1 is attached to the magnet housing 13 by the attractive magnetic force exerted from the magnetic housing 13. Therefore, the steel plate can move up by the carrying apparatus, so that it is possible to carry the steel plate to a desired place.

Figure 6E:
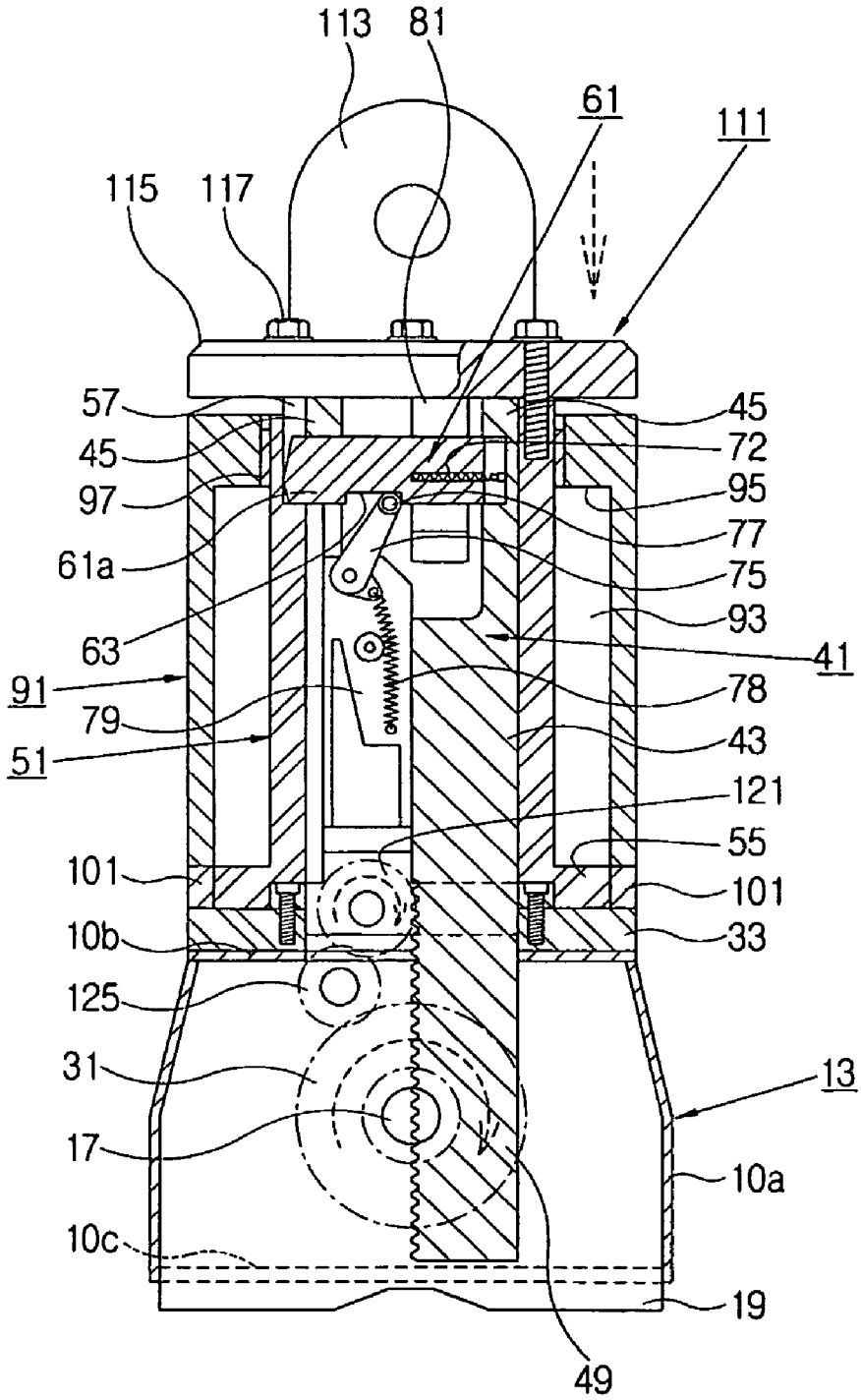

After carrying the steel plate attached to the lifting magnet 1 to the desired place, the lifting magnet 1 together with the steel plate moves down. Then, the steel plate is first put on the ground, and then the socket 51 together with the slider 41 second moves down along the socket case 91. At this time, because the free end of the latch 75 is in the leftward rotated state by the latch elastic unit 78, the switch pin 77 of the latch 75 is not pressed by the pusher 81 and only the free end of the latch 75 is accommodated in the contract groove 63 of the locking unit 61 as shown in FIG. 6E, thereby allowing the latch 75 to support the locking unit 61. That is, the latch 75 is placed on the latching position.

According as the socket 51 together with the slider 41 second moves down, the rack toothed portion 49 of the slider 41 rotates the respective idle gears 121 and 125 and the pinion 31 in an opposite direction to the rotated direction of when it is second moved up. Therefore, according as the socket 51 together with the slider 41 second-moves down, the bottom plate 115 of the pulling-up unit 111 is put on the upper surface of the socket case 91, so that the rack toothed portion 49 of the slider 41 moves down to the lower plate 10*c* of the housing 10 as shown in FIG. 6A, thereby rotating the pinion 31 and the rotational shaft 17 by an angle of 180 degree in the opposite direction to the rotated direction of when it moves up. Therefore, the different magnetic poles of the rotary magnet 25 and the stationary magnet 27 are faced to each other at the bottom dead point, thereby entering the demagnetization state. That is, the attractive magnetic force is not exerted from the magnet housing 13, so that the lifting magnet 1 is returned to the off state.

In this state, when the lifting magnet 1 is moved up by the carrying apparatus, only the socket 51 connected to the pulling-up unit 111 moves up and the slider 41 does not move up like the initial state of the lifting magnet 1, so that the attractive magnetic force of the lifting magnet 1 is kept being turned off, thereby separating the lifting magnet 1 from the steel plate. Likewise, carrying the steel plate can be continuously performed by operating the lifting magnet 1 separated from the steel plate in the above-described order. Further, when carrying the steel plate is completed, the lifting magnet 1 is put on the ground, and only the socket 51 and the slider 41 are moved up once by a height of ½ from their original positions, thereby keeping the lifting magnet 1 in the initial off state as shown in FIG. 6A. At this time, the band 131 preferably surrounds a predetermined area of the upper portion of the socket 51, and couples the socket 51 with the socket case 91, thereby preventing the socket 51 from moving up out of the socket case 91.

Figure 8:
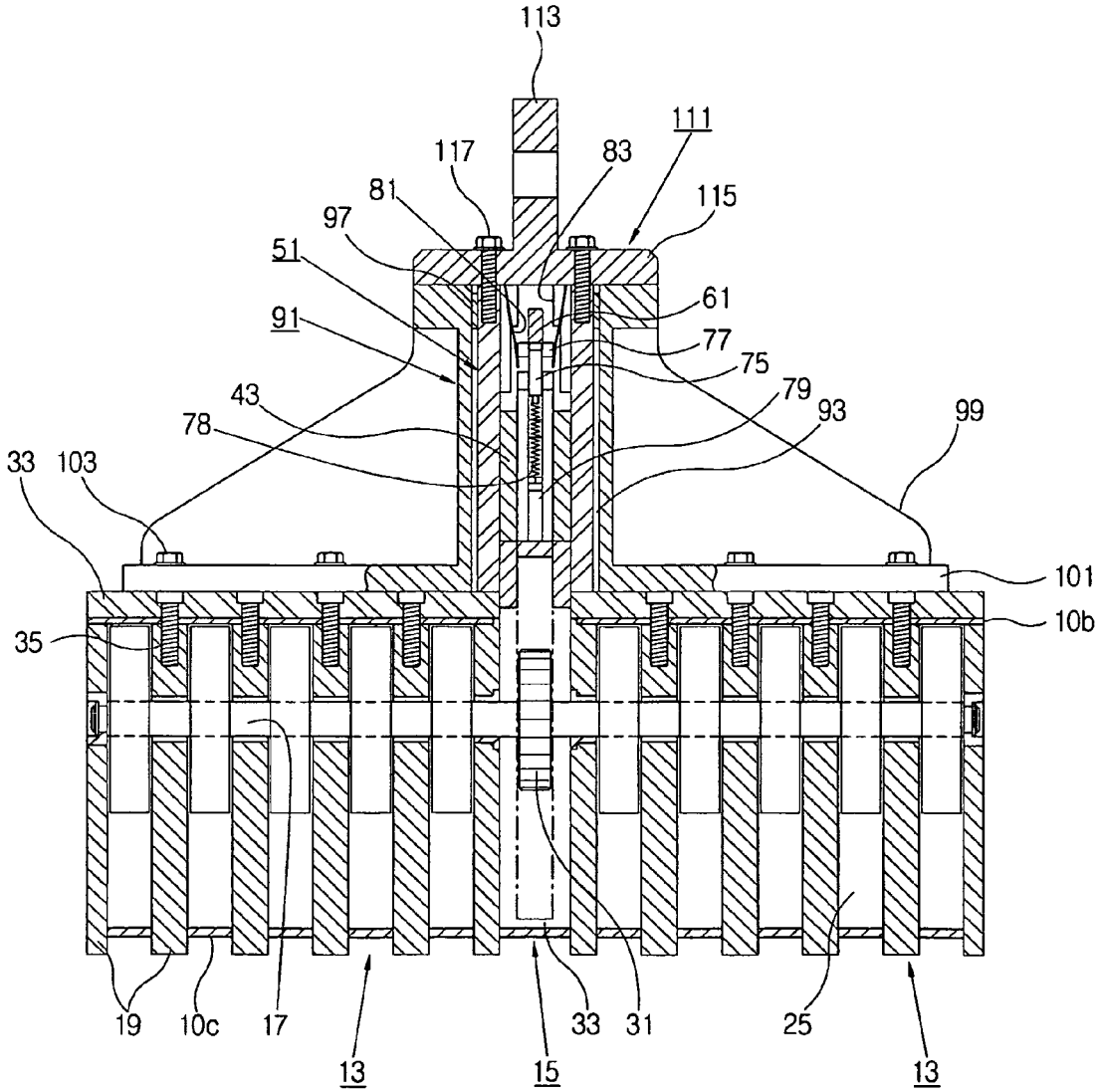
FIG. 8 is a front sectional view of a lifting member according to another embodiment of the present invention.

In the foregoing embodiment, the pair of idle gears 121 and 125 is provided between the pinion 31 and the rack toothed portion 49 of the slider 41. Alternatively, the pinion and the rack toothed portion may be directly connected to each other as shown in FIG. 8.

As described above, in the lifting magnet according to an embodiment of the present invention, only the socket moves up and the attractive magnetic force is kept being turned off when the lifting magnet moves up from the initial off state of the attractive magnetic force; both the socket and the slider are moved up and the attractive magnetic force is set as the on state when the lifting magnet moves up again in the state that the lifting magnet is put on the steel plate to be carried; both the socket and the slider move down and the attractive magnet force is set as the off state when the lighting magnet together with the steel plate moves down; and only the socket moves up and the attractive magnetic force is kept being turned off when the lifting magnet moves up again, so that the on and off states of the attractive magnetic force is automatically controlled to lift and carry the steel plate, thereby efficiently and easily performing the carrying operation.

Further, when the lifting magnet moves up from the initial state that the attractive magnetic force is set as the off state and the lifting magnet is put on the ground, the attractive magnetic force is not directly set as the on state, so that the magnet housing is prevented from foreign materials attaching thereto before lifting the steel plate. Thus, the operation for lifting and carrying the steel plate is stably performed, and a worker is protected from risk in safety.

Further, the on and off states of the attractive magnetic force are correctly set, so that the rotational shaft and the rotary magnet are not swayed in the state that the attractive magnetic force is set as the on state, thereby stably keeping the on state of the attractive magnetic force.

In the foregoing embodiment, the locking part is provided in the socket, and the locking unit is provided in the slider. Alternatively, the locking part may be provided in the locking unit, and at the same time, the locking unit may be provided in the socket.

In the foregoing embodiment, one lifting magnet is used for lifting and carrying the steel plate. Alternatively, a plurality of connectors such as a shackle may be coupled to a lower portion of H-section shaped steel or a steel bar, the lifting magnet according to an embodiment of the present invention may be connected to each connector, and the H-section shaped steel or the steel bar together with the lifting magnet are moved up by the carrying apparatus such as the crane, so that the plurality of lifting magnets installed in the lower portion of the H-section shaped steel or the steel bar can be operated at the same time, thereby easily carrying the large sized steel plate that is difficult to be lifted and carried.

As described above, the present invention provides a lifting magnet, in which on and off states of an attractive magnetic force is stably kept, and lifting and carrying operations are conveniently performed.

What is claimed is:

1. A lifting magnet comprising a housing; a rotary magnet unit rotatably accommodated in the housing and comprising a pair of permanent magnets having opposite magnetic poles and a rotational shaft; a stationary magnet unit comprising a pair of permanent magnets surrounding the rotary magnet unit and facing each other across the rotary magnet unit and determining a magnetization state and a demagnetization state according to rotated positions of the rotary magnet unit, the lifting magnet further comprising:

a pinion coupled to the rotational shaft;

a socket moving up and down within a predetermined lifting stroke with respect to the housing;

a slider comprising a toothed rack portion to be engaged with the pinion, moving up and down within the lifting stroke, and rotating the pinion to set the magnetization state at a top dead point and set the demagnetization state at a bottom dead point;

a locking part provided in one of the socket and the slider;

a locking unit provided in the other of the socket and the slider, comprising a locker to be locked to and released from the locking part, and moving both the socket and the slider up and down in the state that the locker is locked to the locking part; and a locking unit driver alternately driving the locking unit to release the locker from the locking part at a first moving operation of the socket, and to lock the locker to the locking part at a second moving operation of the socket.

2. The lifting magnet according to claim 1, wherein the locking unit driver comprises:

an elastic unit provided to slide in a direction transverse to the moving direction of the socket, and exerting a predetermined elastic force to the locking unit to make the locker of the locking unit be locked to the locking part; and a latch resisting the elastic force of the elastic unit, reciprocating between a latching position preventing the locking unit from moving toward the locking part and a releasing position allowing the locking unit to move toward the locking part, and contacting and separating from the locking unit, wherein the latch is placed on the latching position when the socket first moves up and second moves down, and the latch is placed on the releasing position when the socket first moves down and second moves up.

3. The lifting magnet according to claim 2, wherein the locking unit driver comprises:

a latch elastic unit exerting a predetermined elastic force to place the latch on the latching position; and a pusher pressing the latch to place the latch on the releasing position as the socket moves down in the state that the locker is released from the locking part.

4. The lifting magnet according to claim 3, further comprising at least one idle gear provided between the pinion and the slider, rotated while being engaged with the rack toothed portion as the slider moves up and down, and transferring a rotational force to the pinion.

5. The lifting magnet according to claim 2, further comprising at least one idle gear provided between the pinion and the slider, rotated while being engaged with the rack toothed portion as the slider moves up and down, and transferring a rotational force to the pinion.

6. The lifting magnet according to claim 1, further comprising:

a projection protruding from an outer wall of the socket;

a socket case comprising a stopper to stop the projection and to limit the moving up operation of the socket, coupled to the housing, and supporting the socket to move up and down.

7. The lifting magnet according to claim 6 further comprising a band rotatably coupled to the socket case, and coupling the socket with the socket case to prevent the socket from moving up out of the socket case.

8. The lifting magnet according to claim 7, further comprising at least one idle gear provided between the pinion and the slider, rotated while being engaged with the rack toothed portion as the slider moves up and down, and transferring a rotational force to the pinion.

9. The lifting magnetic according to claim 6, further comprising at least one idle gear provided between the pinion and the slider, rotated while being engaged with the rack toothed portion as the slider moves up and down, and transferring a rotational force to the pinion.

10. The lifting magnet according to claim 1, further comprising at least one idle gear provided between the pinion and the slider, rotated while being engaged with the rack toothed portion as the slider moves up and down, and transferring a rotational force to the pinion.

* * * * *